US012716036B2

(12) United States Patent
Emanuele et al.

(10) Patent No.: US 12,716,036 B2
(45) Date of Patent: Aug. 25, 2026

(54) HYDROCARBON CONVERSION PROCESSES

(71) Applicant: ExxonMobil Chemical Patents Inc., Baytown, TX (US)

(72) Inventors: Krystle J. Emanuele, Hummelstown, PA (US); Teng Xu, Houston, TX (US); Maryam Peer, Bridgewater, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 140 days.

(21) Appl. No.: 18/693,100

(22) PCT Filed: Oct. 14, 2022

(86) PCT No.: PCT/US2022/078085
§ 371 (c)(1),
(2) Date: Mar. 18, 2024

(87) PCT Pub. No.: WO2023/069868
PCT Pub. Date: Apr. 27, 2023

(65) Prior Publication Data

US 2024/0287395 A1 Aug. 29, 2024

Related U.S. Application Data

(60) Provisional application No. 63/262,754, filed on Oct. 20, 2021.

(51) Int. Cl.
*C10G 65/12* (2006.01)

(52) U.S. Cl.
CPC ..... *C10G 65/12* (2013.01); *C10G 2300/301* (2013.01); *C10G 2300/302* (2013.01); *C10G 2300/4006* (2013.01); *C10G 2300/4012* (2013.01); *C10G 2300/80* (2013.01); *C10G 2400/06* (2013.01)

(58) Field of Classification Search
CPC ..... C10G 2300/202; C10G 2300/30; C10G 2300/301; C10G 2300/302; C10G 2300/4006; C10G 2300/4012; C10G 2300/80; C10G 2400/06; C10G 31/06; C10G 49/26; C10G 65/12; C10G 69/06; C10G 9/36
See application file for complete search history.

(56) References Cited

U.S. PATENT DOCUMENTS

2017/0096608 A1 4/2017 Banerjee

FOREIGN PATENT DOCUMENTS

| | | | |
|---|---|---|---|
| WO | 2018/111572 | 6/2018 | |
| WO | WO-2018111572 A1 * | 6/2018 | ..... C10G 1/008 |
| WO | 2019/209525 | 10/2019 | |
| WO | 2020/086394 | 4/2020 | |

OTHER PUBLICATIONS

Office Action received for S.A. Patent Application No. 1120242112, mailed on Apr. 9, 2026, 7 pages (3 pages of English Translation and 4 pages of Original Office Action).

* cited by examiner

*Primary Examiner* — Ellen M Mcavoy
*Assistant Examiner* — Chantel Graham
(74) *Attorney, Agent, or Firm* — Shook Hardy & Bacon L.L.P.

(57) ABSTRACT

Hydrocarbon conversion processes. The process can include providing a gas oil feed that can include a gas oil and an olefin. A reactivity R(go) of the gas oil feed can be determined. The R(go) can be compared to a predetermined reference reactivity R(ref). If R(go)>R(ref), the gas oil feed can be heated to a temperature in a range of from 200° C. to 400° C. for a residence time in a range of from 1 minute to 45 minutes to produce a heat-treated gas oil feed having a reactivity R(ht-go), until R(ht-go)≤R(ref). A hydroprocessor feed that includes the gas oil feed if R(go)≤R(ref) or the heat-treated gas oil feed can be fed to a hydroprocessor. The hydroprocessor feed can be hydroprocessed in the hydroprocessor to produce a hydroprocessor effluent that can include a hydroprocessed gas oil.

25 Claims, No Drawings

HYDROCARBON CONVERSION PROCESSES

CROSS-REFERENCE TO RELATED APPLICATIONS

This application is a US national phase application of PCT Application Serial No. PCT/US2022/078085 having a filing date of Oct. 14, 2022, which claims priority to and the benefit of U.S. Provisional Application No. 63/262,754 having a filing date of Oct. 20, 2021, the disclosures of all of which are incorporated herein by reference in their entireties.

FIELD

Embodiments disclosed herein generally relate to hydrocarbon conversion processes. More particularly, such embodiments relate to hydrocarbon conversion processes that include hydroprocessing gas oil feeds or hydrocarbon mixtures that include one or more gas oil feeds.

BACKGROUND

Light olefins, e.g., ethylene, propylene, and butenes, are typically produced by cracking relatively light hydrocarbon feeds such as ethane, propane, butane, and naphthas and/or relatively heavy hydrocarbon feeds, such as gas-oils and crude-oils, utilizing pyrolysis, e.g., steam cracking. The pyrolysis effluent is quenched after leaving the pyrolysis furnace to prevent the cracking reactions from continuing past the point of product generation. The cooled pyrolysis effluent is then separated into a plurality of products, such as the light olefins, pyrolysis naphtha, pyrolysis gas oil, pyrolysis quench oil, and pyrolysis tar. The pyrolysis gas oil is a reactive product due to its olefinic content.

Attempts at hydroprocessing pyrolysis gas oils to reduce viscosity and improve other properties has been hindered due to the fouling of process equipment and/or an undesirable rate of catalyst deactivation. Even if fouling is not a concern the rate of catalyst deactivation undesirably limits the catalyst run length and hydroprocessing conditions that can be used to process the pyrolysis gas oil.

There is a need, therefore, for improved hydrocarbon conversion processes for hydroprocessing gas oil feeds or hydrocarbon mixtures that include one or more gas oil feeds. This disclosure satisfies this and other needs.

SUMMARY

Hydrocarbon conversion processes are provided. In some embodiments, the hydrocarbon conversion process can include (I) providing a gas oil feed that can include a gas oil and an olefin. In some embodiments, at least 70 wt % of the gas oil feed, based on the total weight of the gas oil feed, can have a normal boing point of at least 200° C. and no more than 10 wt % of the gas oil feed, based on the total weight of the gas oil feed, can have a normal boiling point of at least 275° C. The process can also include (II) determining a reactivity R(go) of the gas oil feed and (III) comparing R(go) to a predetermined reference reactivity R(ref). The process can also include (IV) if R(go)>R(ref), heating the gas oil feed to a temperature in a range of from 200° C. to 400° C. for a residence time in a range of from 1 minute to 45 minutes to produce a heat-treated gas oil feed having a reactivity R(ht-go), until R(ht-go)≤R(ref). The process can also include (V) feeding a hydroprocessor feed that can include (i) the gas oil feed if R(go)≤R(ref) or (ii) the heat-treated gas oil feed produced in step (IV) to a hydroprocessor and (VI) hydroprocessing the hydroprocessor feed in the hydroprocessor to produce a hydroprocessor effluent that can include a hydroprocessed gas oil.

In other embodiments, the hydrocarbon conversion process can include (A) providing a raw hydroprocessor feed that can include a mixture of steam cracker gas oil and steam cracker tar. The raw hydroprocessor feed can have a reactivity R(raw) in terms of bromine number, where R(raw)>28. The raw hydroprocessor feed can include olefins. In some embodiments, at least 70 wt % of the steam cracker gas oil can have a normal boing point of at least 200° C. and at most 10 wt % of the steam cracker gas oil can have a normal boiling point of at least 275° C. The steam cracker tar can contain free radicals, have a density at 15° C. of at least 1.10 g/cm$^3$, as measured according to ASTM D70/D70M-21, and can have a viscosity at 50° C. of at least 1,000 cSt, as measured according to ASTM D445-21. In some embodiments, at least 70 wt % of the steam cracker tar can have a normal boiling point of at least 290° C. The process can also include (B) heating the raw hydroprocessor feed to a temperature in a range of from 200° C. to 400° C. for a residence time in a range of from at least 1 minute to 45 minutes to produce a heat-treated raw hydroprocessor feed that can include heat-treated steam cracker gas oil and heat-treated steam cracker tar. The heat-treated raw hydroprocessor feed can have a reactivity in terms of bromine number R(ht-raw), where R(ht-raw)≤28. The process can also include (C) feeding a hydroprocessor feed that can include the heat-treated raw hydroprocessor feed into a hydroprocessor. The process can also include (D) hydroprocessing the hydroprocessor feed in the hydroprocessor to produce a hydroprocessor effluent that can include hydroprocessed steam cracker gas oil and hydroprocessed steam cracker tar.

DETAILED DESCRIPTION

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Moreover, the exemplary embodiments presented below can be combined in any combination of ways, i.e., any element from one exemplary embodiment can be used in any other exemplary embodiment, without departing from the scope of the disclosure.

The indefinite article "a" or "an", as used herein, means "at least one" unless specified to the contrary or the context clearly indicates otherwise. Thus, embodiments using "a hydroprocessor" include embodiments where one or two or more hydroprocessors are used, unless specified to the contrary or the context clearly indicates that only one hydroprocessor is used. Likewise, embodiments using "a hydroprocessing stage" include embodiments where one or two or more hydroprocessing stages are used, unless specified to the contrary.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated.

Certain lower limits, upper limits and ranges appear in one or more claims below. All numerical values are "about" or "approximately" the indicated value, and take into account experimental error and variations that would be expected by a person having ordinary skill in the art.

As used herein, the term "hydrocarbon" means a class of compounds containing hydrogen bound to carbon. The term "Cn" hydrocarbon means hydrocarbon having n carbon atom(s) per molecule, where n is a positive integer. The term "Cn-" hydrocarbon means hydrocarbon having at least n carbon atom(s) per molecule, where n is a positive integer. The term "Cn-" hydrocarbon means hydrocarbon having no more than n number of carbon atom(s) per molecule, where n is a positive integer. "Hydrocarbon" encompasses (i) saturated hydrocarbon, (ii) unsaturated hydrocarbon, and (iii) mixtures of hydrocarbons, including mixtures of hydrocarbon compounds (saturated and/or unsaturated), including mixtures of hydrocarbon compounds having different values of n.

As used herein, the term "olefin" means the portion of the gas oil feed or raw hydroprocessor feed that contains hydrocarbon molecules having olefin unsaturation (at least one unsaturated carbon that is not an aromatic unsaturation) where the hydrocarbon may or may not also have aromatic unsaturation. For example, a vinyl hydrocarbon like styrene, if present in the gas oil feed or other feeds such as a pyrolysis tar, would be included as an olefin.

As used herein, the terms "pyrolysis gas oil feed" and "gas oil feed" are interchangeable and refer to a mixture of hydrocarbons that include a gas oil and an olefin, where at least 70 wt % of the gas oil feed, based on the total weight of the gas oil feed, has a normal boing point of at least 200° C. and no more than 10 wt % of the gas oil feed, based on the total weight of the gas oil feed, has a normal boiling point of at least 275° C.

As used herein the terms "pyrolysis tar" and "tar" are interchangeable and refer to (a) a mixture of hydrocarbons having one or more aromatic components and optionally (b) non-aromatic and/or non-hydrocarbon molecules, the mixture being derived from hydrocarbon pyrolysis, with at least 70%, at least 75 wt %, at least 80 wt %, at least 85 wt %, or at least 90 wt % of the mixture having a normal boiling point of at least 290° C. Pyrolysis tar can include, e.g., ≥50 wt %, ≥75 wt %, or ≥90 wt %, based on the weight of the pyrolysis tar, of hydrocarbon molecules (including mixtures and aggregates thereof) having (i) one or more aromatic components, and (ii) a number of carbon atoms ≥about 15. Pyrolysis tar can also include free radicals, have a density at 15° C. of at least 1.10 g/cm$^3$, as measured according to ASTM D70/D70M-21, and has a viscosity at 50° C. of at least 1,000 cSt, as measured according to ASTM D445-21. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. The term "stream cracker tar" refers to pyrolysis tar obtained from steam cracking.

As used herein, the term "raw hydroprocessor feed" refers to a hydrocarbon mixture that includes a gas oil feed and tar. As such, the raw hydroprocessor feed includes olefins.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All concentrations herein are expressed on the basis of the total amount of the composition in question, unless specified otherwise.

Hydrocarbon Conversion Process Overview

In some embodiments, a gas oil feed that can include gas oil and one or more olefins can be provided. In other embodiments, a raw hydroprocessor feed that can include a mixture of a gas oil feed and tar can be provided. It has been discovered that gas oil feeds and raw hydroprocessor feeds that include the gas oil and one or more olefins, e.g., a pyrolysis gas oil such as steam cracker gas oil, can be hydroprocessed for an appreciable reactor run length without undue reactor fouling and/or undue catalyst deactivation when the feed has a reactivity that does not exceed a reference reactivity. More particularly, it has been found that for a wide range of desirable hydroprocessing conditions, a reference reactivity (R(ref)) can be specified or otherwise established for gas oil feeds and/or raw hydroprocessor feeds. In some embodiments, the R(ref) can be predetermined and can correspond to the greatest reactivity the gas oil feed or raw hydroprocessor feed can have without an undesirable rate of reactor fouling and/or catalyst deactivation occurring during hydroprocessing. In other embodiments, the R(ref) can be a predetermined range of reactivity the gas oil feed and/or raw hydroprocessor feed can have without an undesirable rate of reactor fouling and/or catalyst deactivation occurring during hydroprocessing. Accordingly, a reactivity (R(go)) of the gas oil feed and/or a reactivity (R(raw)) of the raw hydroprocessor feed available for processing can be compared with the R(ref) and processing decisions can be made that can be based, at least in part, on the comparison. The R(ref) can be or can include, but is not limited to, a bromine number, an iodine number, a bromine index, an iodine index, an electron spin resonance (ESR), maleic anhydride number, or any other suitable property.

In some embodiments, the reference reactivity R(ref) can be specified for comparison with the reactivity R(go) of a particular gas oil feed or R(raw) of a particular raw hydroprocessor feed, where R(go) or R(raw) is also determined by bromine number, iodine number, bromine index, electron spin resonance (ESR), maleic anhydride number, or other property. In other words, the R(ref) and the R(go) or the R(raw) can be based on the same or substantially the same property. In some embodiments, the R(ref) and the R(go) or the R(raw) can each be the bromine number, the iodine number, the bromine index, the electron spin resonance (ESR), the maleic anhydride number, or other property.

When R(go)≤R(ref) or when R(go) falls within a predetermined range of R(ref) values, the gas oil feed can be hydroprocessed with decreased reactor fouling and/or a decreased catalyst deactivation rate. Similarly, when R(raw) ≤R(ref) or when R(raw) falls within a predetermined range of R(ref) values, the raw hydroprocessor feed can be hydroprocessed with decreased reactor fouling and/or a decreased catalyst deactivation rate. In some embodiments, the R(go) or the R(raw) can be determined using a suitably prepared gas oil feed sample or raw hydroprocessor feed sample at ambient (e.g., 25° C.) temperature, even though such samples are typically obtained from a gas oil feed or a raw hydroprocessor feed having a much greater temperature, e.g., in a range from 140° C. to 350° C., which can greatly simplify the measurement of R(go) and R(raw).

In some embodiments, at least 70 wt %, at least 73 wt %, at least 75 wt %, at least 77 wt %, at least 80 wt %, at least 83 wt %, at least 85 wt %, at least 87 wt %, at least 90 wt %, or at least 93 wt % of the gas oil feed or the gas oil feed in the raw hydroprocessor feed, based on the total weight of the gas oil feed or the gas oil feed in the raw hydroprocessor feed, can have a normal boing point of at least 200° C. In some embodiments, no more than 10 wt %, nor more than 9 wt %, no more than 8 wt %, no more than 7 wt %, more than 6 wt %, no more than 5 wt %, or no more than 3 wt % of the gas oil feed or the gas oil feed in the raw hydroprocessor feed, based on the total weight of the gas oil feed or the gas oil feed in the raw hydroprocessor feed, can have a normal boiling point of at least 275° C. In some embodiments, the gas oil feed can be a pyrolysis gas oil separated from a pyrolysis effluent. In some embodiments, the gas oil feed can be a steam cracker gas oil separated from a steam cracker effluent. The normal boiling point of the gas oil feed or the gas oil feed in the raw hydroprocessor feed can be measured according to ASTM D6352-19e1 or ASTM D-2887-19ae2.

In some embodiments, the gas oil feed or the gas oil feed in the raw hydroprocessor feed can have a viscosity at 50° C. of no greater than $2\times10^{-6}$ $m^2/s$, no greater than $1.7\times10^{-6}$ $m^2/s$, no greater than $1.5\times10^{-6}$ $m^2/s$, no greater than $1.3\times10^{-6}$ $m^2/s$, no greater than $1\times10^{-6}$ $m^2/s$, or no greater than $0.9\times10^{-6}$ $m^2/s$. The viscosity of the gas oil feed or the gas oil feed in the raw hydroprocessor feed can be measured according to ASTM D445-21.

The reactivity R(go) of the gas oil feed or the reactivity R(raw) of the raw hydroprocessor feed can be determined. The determined reactivity R(go) of the gas oil feed or the determined reactivity R(raw) of the hydroprocessor feed can be compared to the predetermined reference reactivity R(ref). If R(go)>R(ref) or if R(raw)>R(ref), the gas oil feed or the raw hydroprocessor feed can be heated to a temperature in a range from 200° C., 225° C., 250° C., or 275° C. to 300° C., 325° C., 350° C., 375° C., or 400° C. If R(go)>R(ref) or if R(raw)>R(ref), the gas oil feed or the raw hydroprocessor feed can be heated to the temperature in the range from 200° C. to 400° C. for a residence time in a range from 1 minute, 5 minutes, 10 minutes, or 15 minutes to 25 minutes, 30 minutes, 35 minutes, 40 minutes, 45 minutes, or 50 minutes Heating the gas oil feed or the raw hydroprocessor feed to the temperature in a range from 200° C. to 400° C. for the residence time can produce a heat-treated gas oil feed or a heat-treated raw hydroprocessor feed. The heat-treated gas oil feed or the heat-treated raw hydroprocessor feed can have a reactivity R(ht-go) or R(ht-raw), respectively. The gas oil feed or the raw hydroprocessor feed can be heated to the temperature in a range from 200° C. to 400° C. for the residence time until R(ht-go)≤R(ref) or until R(ht-raw)≤R(ref). In some embodiments, the residence time the gas oil feed or the raw hydroprocessor feed is heated to the temperature in the range from 200° C. to 400° C. can be greater than 45 or 50 minutes, i.e., as long as necessary, to produce a heat-treated gas oil feed having a R(ht-go) or a heat-treated raw hydroprocessor feed R(ht-raw) that can be less than R(ref).

A hydroprocessor feed that includes the gas oil feed if R(go)≤R(ref) or the heat-treated gas oil feed having the reactivity R(ht-go)≤R(ref), or the raw hydroprocessor feed if R(raw)≤R(ref), or the heat-treated raw hydroprocessor feed having the reactivity R(ht-raw)≤R(ref) can be fed into a hydroprocessor. The hydroprocessor feed can be hydroprocessed in the hydroprocessor to produce a hydroprocessor effluent that can include a hydroprocessed gas oil.

Reactivity Values

The bromine number of the gas oil feed, the heat-treated gas oil feed, the raw hydroprocessor feed, or the heat treated raw hydroprocessor feed can be measured by electrochemical titration according to ASTM D1159-07(2017). The titration can be carried out on a gas oil feed sample having a temperature≤ambient temperature, e.g., ≤25° C. Suitable methods for measuring the bromine number can include those disclosed by D. J. Ruzicka and K. Vadum in Modified Method Measures Bromine Number of Heavy Fuel Oils, Oil and Gas Journal, Aug. 3, 1987, 48-50. The bromine number is reported as the grams of bromine ($Br_2$) consumed, e.g., by reaction and/or sorption, per 100 grams of sample. In some embodiments, a bromine index can be used as an alternative to the bromine number for establishing the reactivity R(go), R(ht-go), and R(ref). The bromine index is the amount of $Br_2$ mass in mg consumed by 100 grams of sample.

In other embodiments, the iodine number can be used as an alternative to the bromine number for establishing the reactivity R(go), R(ht-go), R(raw), R(ht-raw), and R(ref). In some embodiments, the bromine number can be approximated from the iodine number by the formula:

$$BN \sim \text{Iodine Number (Atomic Weight of } I_2)/(\text{Atomic Weight of } Br_2).$$

The electron spin resonance of the gas oil feed, the heat-treated gas oil feed, the raw hydroprocessor feed, or the heat treated raw hydroprocessor feed can be measured via an Electron Spin Resonance Spectrometer such as Model JES FA 200 (available from JEOL, Japan). The ESR measurement can be carried out at any convenient temperature, e.g., ambient temperature. In some embodiments, the electron spin resonance spectrometer can be calibrated using, e.g., 2,2-diphenyl-1-picrylhydrazyl (DPPH).

For simplicity and ease of description, R(ref), R(go), (Rht-go), R(raw), and R(ht-raw) will be further described with respect to the bromine number. It should be understood, however, that the bromine index, iodine number, electron spin resonance, or any other desired property can also be used instead of or in addition to the bromine number.

Determining R(ref)

R(ref) can be established by catalytically hydroprocessing a sequence of gas oil feeds or raw hydroprocessor feeds in the presence of molecular hydrogen. In some embodiments, the R(ref) can be established for a wide range of hydroprocessing conditions. Although R(ref) for particular hydroprocessing conditions or a set of particular hydroprocessing process conditions spanning a range of process conditions can be determined from modeling studies, e.g., by modeling the yield of heavy hydrocarbon deposits under selected hydroprocessing conditions, it can typically be more convenient to determine R(ref) experimentally.

One method to determine R(ref) experimentally can include providing a set of approximately ten gas oil feeds or gas oil feed mixtures or raw hydroprocessor feeds or raw hydroprocessor feed mixtures. Each feed in the set can have an R(go) or an R(raw) that can be different from that of the others (ideally the R(go) or R(raw) values are substantially equally spaced), and each has an R(go) or R(raw), if measured by bromine number, in a range from 23 to 28. A table of reactivity ("R") values can be produced by hydroprocessing each feed in the set by hydroprocessing each feed at a plurality of selected hydroprocessing conditions and observing whether reactor fouling and/or catalyst deactivation occurs before a pre-determined hydroprocessing time duration has elapsed. When it is desired to designate for hydroprocessing a feed that is not a member of the foregoing set under particular hydroprocessing conditions within the plurality of selected hydroprocessing conditions, R(go) or R(raw) of the feed can be measured, and the value of R(go) or R(raw) can be compared to that R selected among the tabulated R(ref) values that most closely corresponds to the selected hydroprocessing conditions. Hydroprocessing of the designated feed can be carried out efficiently with little or no reactor fouling and/or catalyst deactivation at the selected hydroprocessing conditions when R(go), R(ht-go), R(raw), or R(ht-raw) is less than R(ref).

As an example, when hydroprocessing a gas oil feed, a heat-treated gas oil feed, a raw hydroprocessor feed, or a heat-treated raw hydroprocessor feed under hydroprocessing conditions within the plurality of selected hydroprocessing conditions, e.g. selected conditions which include a temperature of at least 200° C., a pressure of at least 8 MPa, a weight hourly space velocity, based on the gas oil feed and the tar, of at least 0.3 $hr^{-1}$, and a molecular hydrogen consumption rate in a range of from 270 standard cubic meters of molecular hydrogen per cubic meter of the gas oil feed or the heat-treated gas oil feed to 534, 1,069, or 1,780 standard cubic meters of molecular hydrogen per cubic meter of the gas oil feed or the heat-treated gas oil feed, R(ref) can be a bromine number in a range from 23 to 28. In some embodiments, the R(ref) can be a bromine number in a range from 23, 23.5, 24, 25, 25.5, or 26 to 26.5, 27, 27.5, or 28. In some embodiments, the R(go) or R(raw) can be a bromine number ≥28, ≥29, ≥30, ≥33, ≥35, ≥37, ≥40, ≥43, or ≥45. When the R(go) or the R(raw) of the gas oil feed or the raw hydroprocessor feed is a bromine number >28, the gas oil feed or the raw hydroprocessor feed can be heated to a temperature in a range of from 200° C. to 400° C. for a residence time in a range of from 1 minute to 45 minutes to produce the heat-treated gas oil feed having a reactivity R(ht-go), until R(ht-go)≤R(ref) or to produce the heat-treated raw hydroprocessor feed having a reactivity R(ht-raw), until R(hg-raw)≤R(ref).

Pyrolysis Gas Oil

Pyrolysis gas oil is a product or by-product of hydrocarbon pyrolysis, e.g., steam cracking. Effluent from the hydrocarbon pyrolysis is typically in the form of a mixture that includes unreacted feed, unsaturated hydrocarbon produced from the feed during the pyrolysis, pyrolysis gas oil, and other pyrolysis products such as pyrolysis tar. In addition to hydrocarbons, the feed to the hydrocarbon pyrolysis process can also, in some embodiments, include a diluent, e.g., one or more of nitrogen, water, etc. Steam cracking, which produces steam cracker gas oil (SCGO), is a form of pyrolysis that uses a diluent that includes an appreciable amount of steam. Steam cracking will be described in more detail. It should be understood, however, that the invention is not limited to pyrolysis gas oils produced by steam cracking and this description is not meant to foreclose producing pyrolysis gas oil by other pyrolysis methods within the broader scope of the invention.

Steam Cracking

A steam cracking plant typically includes a furnace facility for producing steam cracking effluent and a recovery facility for removing from the steam cracking effluent a plurality of products and by-products, e.g., light olefins, steam cracker gas oil, steam cracker tar, and other products. The furnace facility generally includes a plurality of steam cracking furnaces Steam cracking furnaces typically include two main sections a convection section and a radiant section, where the radiant section typically contains fired heaters. Flue gas from the fired heaters is conveyed out of the radiant section to the convection section. The flue gas flows through the convection section and is then conducted away, e.g., to one or more treatments for removing combustion by-products such as NOx. A hydrocarbon feed is introduced into tubular coils (convection coils) located in the convection section. Steam is also introduced into the coils, where it combines with the hydrocarbon feed to produce a steam cracking feed. The combination of indirect heating by the flue gas and direct heating by the steam leads to vaporization of at least a portion of the hydrocarbon component of the steam cracking feed. The steam cracking feed containing the vaporized hydrocarbon component is then transferred from the convection coils to the radiant tubes located in the radiant section. Indirect heating of the steam cracking feed in the radiant tubes results in cracking of at least a portion of the hydrocarbon component in the steam cracking feed. Steam cracking conditions in the radiant section, can include, e.g., one or more of (i) a temperature in the range of 760° C. to 880° C., (ii) a pressure in the range of from 1.0 to 5.0 bars (absolute), and/or (iii) a cracking residence time in the range of from 0.1 to 2 seconds.

Steam cracking effluent is conducted out of the radiant section and is quenched, typically with water, quench oil, or other quench medium. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, steam cracker tar, water, light saturated hydrocarbons, molecular hydrogen, etc.

The steam cracking feed typically includes hydrocarbon and steam, e.g., ≥10 wt %, ≥25 wt %, ≥50 wt %, or ≥65 wt % of hydrocarbon, based on the weight of the steam cracking feed. Although the hydrocarbon can include one or more light hydrocarbons such as methane, ethane, propane, butane, etc., it can be particularly advantageous to include a significant amount of higher molecular weight hydrocarbons. While doing so typically decreases feed cost, steam cracking such a feed typically increases the amount of steam cracker gas oil and other by-products such as steam cracker tar in the steam cracking effluent. One suitable steam cracking feed can include ≥1 wt %, ≥10 wt %, ≥25 wt %, or ≥50 wt % of hydrocarbon compounds that are in the liquid and/or solid phase at ambient temperature and atmospheric pressure, based on the weight of the steam cracking feed.

The steam cracking feed can include water and hydrocarbon. The hydrocarbon typically includes ≥10 wt %, ≥50 wt %, or ≥90 wt % of one or more of naphtha, gas oil, vacuum gas oil, waxy residues, atmospheric residues, residue admixtures, or crude oil (including those that include ≥0.1 wt % asphaltenes), based on the weight of the hydrocarbon. When the hydrocarbon includes crude oil and/or one or more fractions thereof, the crude oil is optionally desalted prior to being included in the steam cracking feed. A crude oil fraction can be produced by separating atmospheric pipestill (APS) bottoms from a crude oil followed by vacuum pipestill (VPS) treatment of the atmospheric pipestill bottoms.

Suitable crude oils include, e.g., high-sulfur virgin crude oils, such as those rich in polycyclic aromatics. For example, the hydrocarbon in the steam cracking feed can include ≥90 wt % of one or more crude oils and/or one or more crude oil fractions, such as those obtained from an atmospheric pipestill and/or vacuum pipestill, waxy residues, atmospheric residues, naphthas contaminated with crude, various residue admixtures, and steam cracker tar. In some embodiments, the hydrocarbon can be or include the hydrocarbons or hydrocarbon feedstocks disclosed in U.S. Pat. Nos. 7,993,435; 8,696,888; 9,327,260; 9,637,694; 9,657,239; and 9,777,227; and International Patent Application Publication No. WO 2018/111574.

Steam cracker gas oil can typically be removed from the quenched effluent in one or more separation stages, e.g., as a side draw from a primary fractionator. Such a steam cracker gas oil can provide a gas oil feed in which at least 70 wt %, at least 75 wt %, at least 80 wt %, at least 85 wt %, or at least 90 wt % of the gas oil feed, based on the total weight of the gas oil feed, can have a normal boing point of at least 200° C. and no more than 10 wt %, no more than 7 wt %, no more than 5 wt %, or no more than 3 wt % of the gas oil feed, based on the total weight of the gas oil feed, can have a normal boiling point of at least 275° C.

Steam cracker tar can typically be removed from the quenched effluent in one or more separation stages, e.g., as bottoms stream from a primary fractionator or a tar knock out drum located upstream of the primary fractionator. Typically, the quenched effluent can include ≥1 wt % of C2 unsaturates and ≥0.1 wt % of tar heavies, the weight percent values being based on the weight of the pyrolysis effluent. It can also be typical for the quenched effluent to include ≥0.5 wt % of tar heavies, such as ≥1 wt % of tar heavies.

Tar heavies is a product of hydrocarbon pyrolysis that has an atmospheric boiling point ≥565° C. that includes ≥5 wt % of molecules having a plurality of aromatic cores based on the weight of the product. The tar heavies are typically solid at 25° C. and generally include the fraction of steam cracker tar that is not soluble in a 5:1 (vol:vol.) ratio of n-pentane: SCT at 25° C. Tar heavies generally include asphaltenes and other high molecular weight molecules. The tar heavies is typically in the form of aggregates that include hydrogen and carbon and have an average size in the range of 10 nm to 300 nm in at least one dimension and an average number of carbon atoms ≥50. Generally, the tar heavies include ≥50 wt %, ≥80 wt %, or ≥90 wt % of aggregates having a C:H atomic ratio in the range of from 1 to 1.8, a molecular weight in the range of 250 to 5,000, and a melting point in the range of 100° C. to 700° C.

Utility Fluid

Depending, at least in part, on processing options indicated by the outcome of the R(go) or R(ht-go) or R(raw) or R(ht-raw) vs. R(ref) comparison, the gas oil feed, the heat-treated gas oil feed, the raw hydroprocessor feed, or the heat-treated raw hydroprocessor feed can be hydroprocessed in one or more hydroprocessor stages of a hydroprocessor. In some embodiments, at least one stage of the hydroprocessing of the gas oil feed, the heat-treated gas oil feed, the raw hydroprocessor feed, or the heat-treated raw hydroprocessor feed can be carried out in the presence of a utility fluid. The utility fluid can include a mixture of multi-ring compounds. The multi-ring compounds can be aromatic or non-aromatic and can contain a variety of substituents and/or heteroatoms. For example, the utility fluid can contain ring compounds in an amount ≥40 wt %, ≥45 wt %, ≥50 wt %, ≥55 wt %, or ≥60 wt %, based on the weight of the utility fluid. In some embodiments, at least a portion of the utility fluid can be obtained from a hydroprocessor effluent, e.g., via one or more separations, that can be carried out as disclosed in U.S. Pat. No. 9,090,836.

The utility fluid can include aromatic hydrocarbon, e.g., ≥25 wt %, ≥40 wt %, ≥50 wt %, ≥55 wt %, or ≥60 wt % of aromatic hydrocarbon, based on the weight of the utility fluid. The aromatic hydrocarbon can include, e.g., one, two, and/or three ring aromatic hydrocarbon compounds. For example, the utility fluid can include ≥15 wt %, ≥20 wt %, ≥25 wt %, ≥40 wt %, ≥50 wt %, ≥55 wt %, or ≥60 wt % of 2-ring and/or 3-ring aromatics, based on the weight of the utility fluid. Utilizing a utility fluid that includes aromatic hydrocarbon compounds having 2-rings and/or 3-rings can be advantageous because utility fluids containing these compounds typically exhibit an appreciable solubility blending number ("SBN"). In some embodiments, the utility fluid can have an SBN of at least 90, at least 95, at least 100, at least 105, or at least 110 to at least 120, at least 130, at least 140, at least 150, at least 155, or greater. It has been found that there is a beneficial decrease in reactor plugging when hydroprocessing gas oil feeds, heat-treated gas oil feeds, the raw hydroprocessor feed, or the heat-treated raw hydroprocessor feed provided that, after being combined with the utility fluid, the hydroprocessor feed has an SBN ≥150, ≥155, or ≥160. The SBN is a parameter that relates to the compatibility of an oil with different proportions of a model solvent mixture, such as toluene/n-heptane. The SBN is related to the insolubility number ("$I_N$"), which can be determined in a similar manner, as disclosed in U.S. Pat. No. 5,871,634.

The utility fluid can have a 10% distillation point ≥60° C. and a 90% distillation point ≤425° C., e.g., ≤400° C., as measured according to ASTM D86-20b. In some embodiments, the utility fluid can have a true boiling point distribution with an initial boiling point ≥130° C. ≥150°, ≥177° C., or ≥200° C. and a final boiling point ≤425° C., ≤450° C., ≤500° C., or ≤566° C. True boiling point distributions (the distribution at atmospheric pressure) can be determined, e.g., by conventional methods such as ASTM D7500-15 (2019) When the final boiling point is greater than that specified in the standard, the true boiling point distribution can be determined by extrapolation. A particular form of the utility fluid can have a true boiling point distribution having an initial boiling point ≥130° C. and a final boiling point ≤566° C.; and/or can include ≥15 wt. % of two ring and/or three ring aromatic compounds.

In some embodiments, the amount of utility fluid and the amount of gas oil feed or the heat-treated gas oil feed employed during hydroprocessing can generally be in the range of from 20 wt % to 95 wt % of the gas oil feed or the heat-treated gas oil feed and from 5 wt % to 80 wt % of the utility fluid, based on the combined weight of utility fluid and the gas oil feed or the heat-treated gas oil feed. For example, the relative amounts of utility fluid and the gas oil feed or the heat-treated gas oil feed during hydroprocessing can be in a range of (i) 20 wt % to 90 wt % of the gas oil feed or the heat-treated gas oil feed and 10 wt % to 80 wt % of the utility fluid, or (ii) 40 wt % to 90 wt % of the gas oil feed or the heat-treated gas oil feed and 10 wt % to 60 wt % of the utility fluid. In some embodiments, the utility fluid to the gas oil feed or the heat-treated gas oil feed weight ratio can be ≥0.01, e.g., in a range of 0.05 to 4, 0.1 to 3, or 0.3 to 1.1. In some embodiments, at least a portion of the utility fluid can be combined with at least a portion of the gas oil feed or the heat-treated gas oil feed during the hydroprocessing, e.g., within a hydroprocessing zone, but this is not required. In some embodiments, at least a portion of the utility fluid and at least a portion of the gas oil feed or the heat-treated gas oil feed can be supplied as separate streams and combined into one feed stream (the "hydroprocessor feed") prior to entering the hydroprocessing stage. For example, the gas oil feed or the heat-treated gas oil feed and utility fluid can be combined to produce a hydroprocessor feed upstream of the hydroprocessing stage and the hydroprocessor feed can include, e.g., (i) 20 wt % to 90 wt % of the gas oil feed or the heat-treated gas oil feed and 10 wt % to 80 wt % of the utility fluid, or (ii) 40 wt % to 90 wt % of the gas oil feed or the heat-treated gas oil feed and 10 wt % to 60 wt % of the utility fluid, the weight percent values being based on the weight of the hydroprocessor feed.

In some embodiments, the amount of utility fluid and the amount of the raw hydroprocessor feed or the heat-treated raw hydroprocessor feed employed during hydroprocessing can generally be in the range of from 20 wt % to 95 wt % of the raw hydroprocessor feed or the heat-treated raw hydroprocessor feed and from 5 wt % to 80 wt % of the utility fluid, based on the combined weight of utility fluid and the raw hydroprocessor feed or the heat-treated raw hydroprocessor feed. For example, the relative amounts of utility fluid and the raw hydroprocessor feed or the heat-treated raw hydroprocessor feed during hydroprocessing can be in a range of (i) 20 wt % to 90 wt % of the raw hydroprocessor feed or the heat-treated raw hydroprocessor feed and 10 wt % to 80 wt % of the utility fluid, or (ii) 40 wt % to 90 wt % of the gas oil feed or the heat-treated gas oil feed and 10 wt % to 60 wt % of the utility fluid. In some embodiments, the utility fluid to the raw hydroprocessor feed or the heat-treated raw hydroprocessor feed weight ratio can be ≥0.01, e.g., in a range of 0.05 to 4, 0.1 to 3, or 0.3 to 1.1. In some embodiments, at least a portion of the utility fluid can be combined with at least a portion of the raw hydroprocessor feed or the heat-treated raw hydroprocessor feed during the hydroprocessing, e.g., within a hydroprocessing zone, but this is not required. In some embodiments, at least a portion of the utility fluid and at least a portion of the raw hydroprocessor feed or the heat-treated raw hydroprocessor feed can be supplied as separate streams and combined into one feed stream (the "hydroprocessor feed") prior to entering the hydroprocessing stage. For example, the raw hydroprocessor feed or the heat-treated raw hydroprocessor feed and utility fluid can be combined to produce a hydroprocessor feed upstream of the hydroprocessing stage and the hydroprocessor feed can include, e.g., (i) 20 wt % to 90 wt % of the raw hydroprocessor feed or the heat-treated raw hydroprocessor feed and 10 wt % to 80 wt % of the utility fluid, or (ii) 40 wt % to 90 wt % of the raw hydroprocessor feed or the heat-treated raw hydroprocessor feed and 10 wt % to 60 wt % of the utility fluid, the weight percent values being based on the weight of the hydroprocessor feed.

In some embodiments, the utility fluid can be produced by hydroprocessing a pyrolysis tar separated from the cooled steam cracker effluent. In some embodiments, the utility fluid can be the same or similar to the utility fluids disclosed in U.S. Pat. Nos. 9,090,836; 9,637,694; and 9,777,227; and International Patent Application Publication No. WO 2018/111574. It should be understood that the utility fluid can be produced via any suitable process. In some embodiments, one or more aromatic ring compounds or one or more aromatic ring compounds and one or more non-aromatic ring compounds can be mixed, blended, combined, or otherwise contacted to produce the utility fluid having the composition disclosed herein.

The composition of the utility fluid can be determined using any suitable test method or combination of test methods. In some embodiments, conventional methods can be used to determine the types and amounts of compounds in the multi-ring classes disclosed above in the utility fluid (and other compositions), though any method can be used. For example, it has been found that two-dimensional gas chromatography ("2D GC") is a convenient methodology for performing a quantitative analysis of samples of tar, hydroprocessed product, and other streams and mixtures. These methods for identifying the types and amounts of compounds are not meant to foreclose other methods for identifying molecular types and amounts, e.g., other gas chromatography/mass spectrometry (GC/MS) techniques. Methods for determining the composition of the utility fluid product can include those disclosed in U.S. Pat. No. 9,777,227.

Pyrolysis Tar

In some embodiments, at least one stage of the hydroprocessing of the gas oil feed or the heat-treated gas oil feed can be carried out in the presence of a tar, the utility fluid, or both the tar and the utility fluid. In some embodiments, the tar can have a reactivity R(tar). In some embodiments, at least 70 wt %, at least 75 wt %, at least 80 wt %, at least 85 wt %, or at least 90 wt % of the tar, based on the total weight of the tar, can have a normal boiling point of at least 290° C., at least 300° C., at least 310° C., or at least 325° C. In some embodiments, the R(tar) can be ≤R(ref). In other embodiments, the R(tar) can be >R(ref) and the tar can be subjected to heat soaking under the same conditions as the gas oil feed such that a heat-treated tar has a reactivity R(ht-tar)≤R(ref). In some embodiments, the tar can be heat treated in the presence of the gas oil feed. For example, the raw hydroprocessor feed that can include a mixture of a gas oil feed and tar can be heat treated to produce a heat-treated raw hydroprocessor feed having a R(ht-raw)≤R(ref). In some embodiments, the tar can be fed into the hydroprocessor and hydroprocessed therein such that the hydroprocessor effluent further includes hydroprocessed tar. In some embodiments, the gas oil feed and at least one of the utility fluid and the tar can be combined upstream of the hydroprocessor to form the hydroprocessor feed that can be fed into at least one hydroprocessing zone disposed within the hydroprocessor.

In some embodiments, the gas oil feed can include the tar that can contain free radicals, where at least 70 wt % of the tar, based on the total weight of the tar, can have a normal boiling point of at least 290° C. such that if the gas oil feed is heated to produce the heat-treated gas oil feed such heat-treated gas oil feed further includes heat-treated tar. In some embodiments the gas oil feed can include 10 wt %, 12 wt %, 15 wt %, 17 wt %, or 20 wt % to 25 wt %, 27 wt %, 30 wt %, 33 wt %, 35 wt %, 37 wt %, or 40 wt % of a combined amount of gas oil and olefin and 60 wt %, 63 wt %, 65 wt %, 67 wt %, or 70 wt % to 75 wt %, 77 wt %, 80 wt %, 83 wt %, 85 wt %, 87 wt %, or 90 wt % of tar, based on the combined weight of the gas oil, the olefin, and the tar.

In some embodiments, the hydroprocessor feed can include 5 wt %, 7 wt %, 10 wt %, 12 wt %, or 15 wt % to 17 wt %, 20 wt %, 23 wt %, 25 wt %, 30 wt %, or 35 wt % of a combined amount of the gas oil and the olefin in the gas oil feed or the heat treated gas oil feed, 25 wt %, 27 wt %, 30 wt %, 33 wt %, 35 wt %, or 37 wt % to 40 wt %, 43 wt %, 45 wt %, 47 wt %, 50 wt %, 53 wt %, or 55 wt % of the utility fluid, and 30 wt %, 33 wt %, 35 wt %, 37 wt %, 40 wt %, or 43 wt % to 45 wt %, 47 wt %, 50 wt %, 53 wt %, 55 wt %, 57 wt %, or 60 wt % of the tar or the heat-treated tar, where all weight percent values are based on the combined weight of the gas oil feed or the heat-treated gas oil feed, the utility fluid, and the tar or the heat-treated tar. When the gas oil feed includes the gas oil, the olefin, and tar, the hydroprocessor feed can include 5 wt %, 7 wt %, 10 wt %, 12 wt %, or 15 wt % to 17 wt %, 20 wt %, 23 wt %, 25 wt %, 30 wt %, or 35 wt % of a combined amount of the gas oil and the olefin in the gas oil feed or the heat treated gas oil feed, 25 wt %, 27 wt %, 30 wt %, 33 wt %, 35 wt %, or 37 wt % to 40 wt %, 43 wt %, 45 wt %, 47 wt %, 50 wt %, 53 wt %, or 55 wt % of the utility fluid, and 30 wt %, 33 wt %, 35 wt %, 37 wt %, 40 wt %, or 43 wt % to 45 wt %, 47 wt %, 50 wt %, 53 wt %, 55 wt %, 57 wt %, or 60 wt % of the tar in the tar or heat-treated tar, where all weight percent values are based on the combined weight of the gas oil feed or the heat-treated gas oil feed, the utility fluid, and the tar or the heat-treated tar.

As noted above, conventional separation equipment can be used to separate steam cracker tar and other products and by-products from the quenched steam cracker effluent, e.g., one or more flash drums, knock out drums, fractionators, water-quench towers, indirect condensers, etc. Suitable separation stages are described in U.S. Pat. No. 8,083,931, for example. Steam cracker tar can be obtained from the quenched effluent itself and/or from one or more streams that have been separated from the quenched effluent. For example, steam cracker tar can be obtained from a bottoms stream of a primary fractionator used to separate the steam cracker effluent, from a flash-drum bottoms (e.g., the bottoms of one or more flash drums located downstream of the pyrolysis furnace and upstream of the primary fractionator), or a combination thereof. Certain steam cracker tars can include a mixture of primary fractionator bottoms and tar knock-out drum bottoms.

A typical steam cracker tar stream from one or more of these sources generally contains ≥90 wt %, ≥95 wt %, or ≥99 wt % of steam cracker tar, based on the weight of the stream. In some embodiments, more than 90 wt % of the remainder of the weight of the steam cracker tar stream, e.g., the part of the stream that is not steam cracker tar, if any, is typically particulates. The steam cracker tar typically includes ≥50 wt, ≥75 wt %, or ≥90 wt % of tar heavies in the quenched steam cracker effluent, based on the total weight of tar heavies in the quenched effluent.

Representative steam cracker tars typically have (i) a tar heavies content in a range of from 5 wt % to 40 wt %, based on the weight of the steam cracker tar, (ii) an API gravity (measured at a temperature of 15.8° C.) of ≤8.5° API, ≤8.0° API, or ≤7.5° API; and (iii) a 50° C. viscosity in the range of 200 cSt to $1.0\times10^7$ cSt, as determined by ASTM D445-21. The steam cracker tar can have a sulfur content >0.5 wt %, e.g., in a range of 0.5 wt % to 7 wt %, based on the weight of the steam cracker tar. In some embodiment, where the steam cracking feed does not contain an appreciable amount of sulfur, the steam cracker tar can include ≤0.5 wt % sulfur, ≤0.1 wt %, or s≤0.05 wt % sulfur, based on the weight of the steam cracker tar.

In some embodiments, the steam cracker tar can have, e.g., (i) a sulfur content in the range of 0.5 wt % to 7 wt %, based on the weight of the steam cracker tar; (ii) a tar heavies content in the range of from 5 wt % to 40 wt %, based on the weight of the steam cracker tar; (iii) a density at 15° C. in the range of 1.01 g/cm$^3$ to 1.19 g/cm$^3$ or in the range of 1.07 g/cm$^3$ to 1.18 g/cm$^3$; and (iv) a 50° C. viscosity in the range of 200 cSt to $1.0\times10^7$ cSt. In some embodiments, the steam cracker tar can have a kinematic viscosity at 50° C.≥$1.0\times10^4$ cSt, ≥$1.0\times10^5$ cSt, ≥$1.0\times10^6$ cSt, or ≥$1.0\times10^7$ cSt. In some embodiments, the steam cracker tar can have an $I_N$≥80 and >70 wt % of the molecules in the steam cracker tar can have an atmospheric boiling point of ≥290° C. The $I_N$ parameter can be determined using the methods disclosed in U.S. Pat. No. 5,871,634.

In some embodiments, the steam cracker tar can have a normal boiling point ≥290° C., a viscosity at 15° C.≥$1\times10^4$ cSt, and a density ≥1.1 g/cm$^3$. In some embodiments, the steam cracker tar can be a mixture that includes a first steam cracker tar and one or more additional pyrolysis tars, e.g., a combination of the first steam cracker tar and one or more additional steam cracker tars. When the steam cracker tar is a mixture, it is typical for at least 70 wt % of the mixture to have a normal boiling point of at least 290° C. and include free radicals that contribute to the reactivity of the steam cracker tar under hydroprocessing conditions. When the mixture includes a first and second pyrolysis tar (one or more of which is optionally a steam cracker tar) ≥90 wt % of the second pyrolysis tar can optionally have a normal boiling point ≥290° C.

Hydroprocessing

The hydroprocessor feed can be hydroprocessed in the presence of a treatment gas that includes molecular hydrogen, and generally in the presence of at least one catalyst. The hydroprocessing produces a hydroprocessed effluent that typically exhibits one or more of: a decreased viscosity, decreased atmospheric boiling point range, and increased hydrogen content as compared to the hydroprocessor feed. These features lead in turn to improved compatibility of the hydroprocessor effluent with other heavy oil blendstocks, and improved utility as a fuel oil and/or a blend-stock.

The hydroprocessing of the hydroprocess or feed can be described as one or more of: hydrocracking (including selective hydrocracking), hydrogenation, hydrotreating, hydrodesulfurization, hydrodenitrogenation, hydrodemetallation, hydrodearomatization, hydroisomerization, and hydrodewaxing. The hydroprocessing can be carried out in at least one vessel or zone that can be located within a hydroprocessing stage downstream of the pyrolysis stage and the stage or stages within which the hydroprocessed effluent can be recovered. Typically, the hydroprocessing temperatures in a hydroprocessing zone is the average temperature of the catalyst bed disposed within the hydroprocessing reactor (one half the difference between the inlet temperature and the outlet temperature of the catalyst bed). When the hydroprocessing reactor contains more than one hydroprocessing zone and/or more than one catalyst bed the hydroprocessing temperature is the average temperature in the hydroprocessing reactor, e.g., one half the difference between the temperature of the most upstream catalyst bed inlet and the temperature of the most downstream catalyst bed outlet temperature.

Hydroprocessing can be carried out in the presence of hydrogen, e.g., by (i) combining molecular hydrogen with the hydroprocessor feed and/or the optional utility fluid upstream of the hydroprocessing, and/or (ii) introducing molecular hydrogen to the hydroprocessing stage via one or more conduits or lines. Although relatively pure molecular hydrogen can be utilized for the hydroprocessing, it is generally desirable to utilize a "treat gas" that contains sufficient molecular hydrogen for the hydroprocessing and optionally other species, e.g., nitrogen and/or light hydrocarbons such as methane, that generally do not adversely interfere with or affect either the reactions or the products. The treat gas can optionally contain ≥about 50 vol % or ≥about 75 vol % of molecular hydrogen, based on the total volume of treat gas introduced into the hydroprocessing stage.

In some embodiments, when the utility fluid is used, the gas oil feed, the heat-treated gas oil feed, the raw hydroprocessor feed, or the heat-treated raw hydroprocessor feed can be upgraded before it is combined with the optional utility fluid to produce the hydroprocessor feed. For example, the gas oil feed or the heat-treated gas oil feed can be introduced to a separation stage for separation of one or more light gases and/or particulates from the gas oil feed or the heat-treated gas oil feed. An upgraded gas oil feed or upgraded heat-treated gas oil feed can be collected and combined with the optional utility fluid to produce the hydroprocessor feed that can be introduced into a pre-heater. In some embodiments, the hydroprocessor feed, which can be primarily in liquid phase, can be introduced into a supplemental pre-heat stage. The supplemental pre-heat stage can be, e.g., a fired heater. Recycled treat gas that can include molecular hydrogen can be obtained from the hydroprocessing stage and, if necessary, can be mixed with fresh treat gas. In some embodiments, the treat gas can be introduced into a second pre-heater before being introduced into the supplemental pre-heat stage. Fouling in the hydroprocessor can be decreased by increasing the pre-heater duty in the pre-heaters. It has surprisingly been found that when R(go), R(ht-go), R(raw), or R(ht-raw)≤R(ref) that the pre-heater duty can be decreased. Even more surprisingly, it has been found that when R(go), R(ht-go), R(raw), or R(ht-raw) are bromine numbers ≤28, e.g., in a range from 23 to 28, that it is not necessary to carry out a mild hydroprocessing of the gas oil feed, the heat-treated gas oil feed, the raw hydroprocessor feed, or the heat-treated raw hydroprocessor feed before hydroprocessing under more conventional/aggressive hydroprocessing conditions as compared to the mild/less aggressive hydroprocessing conditions. Beneficially, this is the case even for a pyrolysis gas oil feeds or raw hydroprocessor feeds having an initial R(go) or R(raw) before treatment that is a bromine number >28.

The pre-heated hydroprocessor feed can be combined with the pre-heated treat gas and introduced into a hydroprocessing reactor. In some embodiments, one or more mixing devices can be utilized for combining the pre-heated hydroprocessor feed with the pre-heated treat gas in the hydroprocessing reactor, e.g., one or more gas-liquid distributors of the type conventionally utilized in fixed bed reactors. The hydroprocessing can be carried out in the presence of a catalytically effective amount of at least one hydroprocessing catalyst located in at least one catalyst bed. Additional catalyst beds, e.g., a second or a third catalyst bed, or more catalyst beds, can be connected in series with the first catalyst bed with optional intercooling using additional treat gas between beds.

In some embodiments, a preferred hydroprocessing stage can include a first hydroprocessing reactor that can be operated at a first temperature, e.g., 240° C. to 260° C., a second hydroprocessing reactor that can be operated at a second temperature that can be greater than the first temperature, e.g., 250° C. to 300° C., and a third hydroprocessing reactor that can be operated at a third temperature that can be greater than the second temperature, e.g., 300° C. to 400° C. In such embodiments, the first hydroprocessing reactor, the second hydroprocessing reactor, and the third hydroprocessing reactor can include the same or different number of catalyst beds with respect to one another. In one example, the first hydroprocessing reactor can include one catalyst bed, the second hydroprocessing reactor can include two or three catalyst beds serially arranged with respect to one another, and the third hydroprocessing reactor can include three, four, or five catalyst beds serially arranged with respect to one another. The amount and composition of the catalysts disposed within each catalyst bed can be the same or different with respect to one another.

In some embodiments, when the hydroprocessing stage includes multiple hydroprocessing reactors, the amount of molecular hydrogen introduced into each hydroprocessing reactor can be the same or different with respect to one another. For example, if the hydroprocessing stage includes a first hydroprocessing reactor with a single catalyst bed, a second hydroprocessing reactor that includes two or three catalyst beds, and a third hydroprocessing reactor includes three, four, or five catalyst beds, the amount of molecular hydrogen introduced into each hydroprocessing reactor can be increased as the number of catalyst beds therein increase with respect to one another. In such embodiment, the first, second, and third hydroprocessing reactors can receive, with respect to a total amount of all molecular hydrogen introduced into the three hydroprocessing reactors, 5% to 30%, 10% to 45%, and 50% to 85%, respectively.

Hydroprocessor Effluent

The hydroprocessor effluent can be recovered from the hydroprocessor or hydroprocessing stage. In some embodiments, at least one preheater can be a heat exchanger and the hot hydroprocessing effluent recovered from the hydroprocessing reactor can be used to preheat any one or more feeds. For example, the gas oil feed, the gas oil feed and the utility fluid mixture, the raw hydroprocessor feed, or any other feed can be heated by indirectly transferring heat from the hydroprocessing effluent. Following this optional heat exchange, the hydroprocessor effluent can be introduced into a separation stage that can separate a total vapor product (e.g., heteroatom vapor, vapor-phase cracked products, unused treat gas, etc.) and a total liquid product from the hydroprocessed effluent. The total vapor product can be introduced into an upgrading stage that can include, e.g., one or more amine towers. Fresh amine can be introduced into the amine tower and rich amine can be removed therefrom. Unused treat gas can be conducted away from the upgrading stage, compressed in a compression stage, and introduced as a recycle and for use in the hydroprocessing reactor.

The total liquid product recovered from the separation stage includes hydroprocessed gas oil and, if present, hydroprocessed tar. The utility fluid can be separated from the total liquid product and recycled for use in the hydroprocessing stage. In some embodiments, the total liquid product can be introduced into the separation stage to separate the total liquid product into one or more of hydroprocessed gas oil, additional vapor, and at last one stream suitable for use as recycle as utility fluid or a utility fluid component, and, if present, hydroprocessed tar. The separation stage can be, for example, a distillation column with side-stream draw although other conventional separation methods can also be utilized. In some embodiments, the total liquid product can be separated into an overhead stream, one or more side streams and a bottoms stream. The overhead stream (e.g., vapor) can be conducted away from the separation stage. The bottoms stream typically includes a major amount of the hydroprocessed gas oil or, if present a major amount of hydroprocessed tar. When tar is present in the hydroprocessor feed, a side draw can be recovered from the separation stage as a first side stream and the utility fluid can be recovered from the separation stage as a second side stream.

In some embodiments, operation of the separation stage can be adjusted to shift the boiling point distribution of a side stream so that the side stream has properties desired for the utility fluid, e.g., (i) a true boiling point distribution having an initial boiling point ≥177° C. and a final boiling point ≤566° C. and/or (ii) an SBN ≥100, e.g., ≥120, such as ≥125, or ≥130. In some embodiments, trim molecules can be separated, for example, in a fractionator, from the separation stage bottoms and/or overhead that can be added to the side stream, e.g., the utility fluid stream, as desired.

Hydroprocessing Catalyst

Conventional hydroprocessing catalysts can be utilized for hydroprocessing the hydroprocessor feed, such as those specified for use in resid and/or heavy oil hydroprocessing, but the invention is not limited thereto. Suitable hydroprocessing catalysts include bulk metallic catalysts and supported catalysts. The metals can be in elemental form or in the form of a compound. Typically, the hydroprocessing catalyst includes at least one metal from any of Groups 5 to 10 of the Periodic Table of the Elements (tabulated as the Periodic Chart of the Elements, The Merck Index, Merck &

Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Suitable conventional catalysts include one or more of KF860 available from Albemarle Catalysts Company LP, Houston TX; NEBULAR Catalyst, such as NEBULAR 20, available from the same source; CENTERAR catalyst, available from Criterion Catalysts and Technologies, Houston TX, such as one or more of DC-2618, DN-2630, DC-2635, and DN-3636; ASCENTR Catalyst, available from the same source, such as one or more of DC-2532, DC-2534, and DN-3531; and FCC pretreat catalyst, such as DN3651 and/or DN3551, available from the same source.

In some embodiments, the catalyst can have a total amount of Groups 5 to 10 metals per gram of catalyst of at least 0.0001 grams, or at least 0.001 grams or at least 0.01 grams, in which grams are calculated on an elemental basis. For example, the catalyst can include a total amount of Group 5 to 10 metals in a range of 0.0001 g, 0.001 g, 0.005 g, or 0.01 g to 0.08 g, 0.1 g, 0.3 g, or 0.6 g. In some embodiments, the catalyst can also include at least one Group 15 element. An example of a preferred Group 15 element is phosphorus. When a Group 15 element is utilized, the catalyst can include a total amount of elements of Group 15 in a range of from 0.000001 g, 0.00001 g, 0.00005 g, or 0.0001 g to 0.001 g, 0.03 g, 0.06 g, or 0.1 g.

Hydroprocessing Conditions

The hydroprocessing can be carried out at a temperature of at least 200° C., a pressure of at least 8 MPa, a weight hourly space velocity ("WHSV"), based on the gas oil feed or the heat-treated gas oil feed and, if present, the tar or the heat-treated tar, of at least 0.3 $hr^{-1}$, and a molecular hydrogen consumption rate in a range of from 270 standard cubic meters of molecular hydrogen per cubic meter of the hydroprocessor feed to 534, 1,069, or 1,780 standard cubic meters of molecular hydrogen per cubic meter of the hydroprocessor feed. In some embodiments, the hydroprocessing can be carried out at a temperature of at least 300° C., e.g., in the range of from 300° C., 350° C., or 360° C. to 420° C., 430° C., or 500° C. and a WHSV in the range of from 0.3 $h^{-1}$ to 20 $hr^{-1}$ or 0.3 $hr^{-1}$ to 10 $hr^{-1}$. In some embodiments, the hydroprocessing conditions can include a molecular hydrogen partial pressure that can be ≥8 MPa, ≥9 MPa, or ≥10 MPa. In other embodiments, the hydroprocessing conditions can include a molecular hydrogen partial pressure that can be ≤14 MPa, ≤13 MPa, or ≤12 MPa. The WHSV of the hydroprocessor feed can optionally be ≥0.5 $hr^{-1}$, e.g., in the range of from 0.5 $hr^{-1}$ to 20 $hr^{-1}$, or 0.5 $hr^{-1}$ to 10 $hr^{-1}$. In some embodiments, the WHSV of the hydroprocessor feed can be ≥0.5 $hr^{-1}$, such as ≥1 $hr^{-1}$ and can be ≤5 $hr^{-1}$, ≤4 $hr^{-1}$, or ≤3 $hr^{-1}$.

In some embodiments, the amount of molecular hydrogen supplied to a hydroprocessing stage can be in the range of from 270, 300, 330, or 350 standard cubic meters of molecular hydrogen per cubic meter of the hydroprocessor feed to 400, 450, 475, 500, 534, 1,069, or 1,780 standard cubic meters of molecular hydrogen per cubic meter of the hydroprocessor feed. The indicated molecular hydrogen consumption rate is typical for a hydroprocessor feed that includes ≤5 wt %, ≤3 wt %, ≤1 wt %, or ≤0.5 wt % of sulfur. A greater amount of molecular hydrogen is typically consumed when the pyrolysis tar feed contains a greater sulfur amount.

In some embodiments, the hydroprocessing conditions, when the hydroprocessor feed includes sulfur, can be continuously carried out at a temperature of at least 200° C. for a time period of at least 20 days, at least 25 days, at least 30 days, at least 35 days, at least 40 days, at least 45 days, or at least 50 days while maintaining sulfur conversion of at least 85%, at least 87%, at least 90%, or at least 93%, where the temperature on day 20, 25, 30, 35, 40, 45, or 50 is at most 15%, at most 12%, or at most 10% greater than the temperature on day 1. In some embodiments, the hydroprocessing conditions, when the hydroprocessor feed includes sulfur, can be continuously carried out at a pressure of at least 8 MPa for a time period of at least 20 days, at least 25 days, at least 30 days, at least 35 days, at least 40 days, at least 45 days, or at least 50 days while maintaining sulfur conversion of at least 85%, at least 87%, at least 90%, or at least 93%, where a pressure drop on day 20, 25, 30, 35, 40, 45, or 50 is at most 10%, at most 9%, at most 8%, at most 7%, at most 6%, or at most 5% greater than a pressure drop on day 1. In other embodiments, the hydroprocessing conditions, when the hydroprocessor feed includes sulfur, can be continuously carried out at a temperature of at least 200° C. and a pressure of at least 8 MPa for a time period of at least 20 days, at least 25 days, at least 30 days, at least 35 days, at least 40 days, at least 45 days, or at least 50 days while maintaining sulfur conversion of at least 85%, at least 87%, at least 90%, or at least 93%, where the temperature on day 20, 25, 30, 35, 40, 45, or 50 is at most 15%, at most 12%, or at most 10% greater than the temperature on day 1 and where a pressure drop on day 20, 25, 30, 35, 40, 45, or 50 is at most 10%, at most 9%, at most 8%, at most 7%, at most 6%, or at most 5% greater than a pressure drop on day 1.

EXAMPLES

Example 1: A lab scale batch thermal treatment (heat soaking) unit was used to heat soak a first hydroprocessor feed that included steam cracker gas oil and a second hydroprocessor feed that included a mixture that included 30 wt % of steam cracker gas oil and 70 wt % of steam cracker tar. The first and second hydroprocessor feeds were heat soaked at a pressure of 1,379 kPa in the presence of $N_2$ at a plurality of temperatures (200° C., 250° C., 300° C., and 350° C.) and residence times (5 minutes, 15 minutes and 30 minutes). The bromine number of the first hydroprocessor feed was determined to be 41.4 and the bromine number of the second hydroprocessor feed was determined to be 31.2. The bromine number of the first and second hydroprocessor feeds were also determined after each heat soaking test. The bromine numbers in all examples were determined according to ASTM D1159-07(2017). The test results indicated that in all cases heat soaking decreased the bromine number of the first and second hydroprocessor feeds. More particularly, the bromine numbers of the first and second hydroprocessor feeds after heat soaking at each temperature and time period are shown in Table 1 below.

TABLE 1

| Time | 5 min | 15 min | 30 min |
|---|---|---|---|
| Temperature | | 200° C. | |
| BN of First Feed | 30.8 | 30.3 | 28.9 |
| BN of Second Feed | 30.8 | 28.7 | 27.5 |
| Temperature | | 250° C. | |
| BN of First Feed | 22.2 | 22.9 | 24.6 |
| BN of Second Feed | 25.9 | 24.1 | 23.3 |
| Temperature | | 300° C. | |
| BN of First Feed | 23.2 | 21.5 | 20 |
| BN of Second Feed | 22.1 | 20.5 | 19.2 |

TABLE 1-continued

| Time | 5 min | 15 min | 30 min |
|---|---|---|---|
| Temperature | | 350° C. | |
| BN of First Feed | 17.1 | 12.2 | 12.3 |
| BN of Second Feed | 16 | 16 | 14.5 |
| Temperature | | 400° C. | |
| BN of First Feed | n/a | n/a | n/a |
| BN of Second Feed | 14.3 | 14.1 | 14.5 |

As shown in Table 1, heat soaking the first and second hydroprocessor feeds at a temperature of 250° C. to 400° C. for a residence time between 15 and 30 minutes produced heat-treated hydroprocessor feeds that has a bromine number of less than 28.

The viscosity of the first hydroprocessor feed, prior to heat soaking, was 2.4 cST and the viscosity of the second hydroprocessor feed, prior to heat soaking, was 53 cST. The viscosity of the first and second hydroprocessor feeds after heat soaking at each temperature and time period are shown in Table 2 below. The viscosities were measured at a temperature of 50° C. and were determined according to ASTM D445-21.

TABLE 2

| Time | 5 min | 15 min | 30 min |
|---|---|---|---|
| Temperature | | 200° C. | |
| Viscosity of First Feed (cSt) | 3.35 | 3.30 | 3.29 |
| Viscosity of Second Feed (cSt) | 67 | 92 | 120 |
| Temperature | | 250° C. | |
| Viscosity of First Feed (cSt) | 3.80 | 3.25 | 3.30 |
| Viscosity of Second Feed (cSt) | NA | NA | NA |
| Temperature | | 300° C. | |
| Viscosity of First Feed (cSt) | 4.04 | 4.16 | 4.36 |
| Viscosity of Second Feed (cSt) | NA | NA | NA |
| Temperature | | 350° C. | |
| Viscosity of First Feed (cSt) | 4.52 | 4.46 | 4.49 |
| Viscosity of Second Feed (Unit) | 233 | 184 | 127 |
| Temperature | | 400° C. | |
| Viscosity of First Feed (cSt) | NA | NA | NA |
| Viscosity of Second Feed (cSt) | 124 | 127 | 129 |

As shown in Table 2, the viscosity of the first feed remained relatively flat with a slight increase as the temperature and time of heat soaking increased. In contrast, the viscosity of the second feed varied greatly as the temperature and time of heat soaking changed. With high heat and increased time lengths, the viscosity of the second feed settled at the same final measurement. If heated at a low temperature, viscosity slowly rose to this final measurement at the highest temperature (400° C.), it reached the final measurement within a short time frame (5 min) and remained unchanged. At middle range temperature, viscosity initially jumped quickly and then decreased. Without wishing to be bound by theory, it is believed that this phenomenon is likely indicative of the low boiling range molecules in the second feed.

Example 2: A feed that included 25 wt % of steam cracker gas oil and 75 wt % of steam cracker tar was heat soaked at a pilot plant demonstration unit until the bromine number was less than 28. After heat soaking the feed was mixed with a utility fluid to produce a hydroprocessor feed that included 15 wt % of the heat-soaked steam cracker gas oil, 45 wt % of the heat-soaked steam cracker tar, and 40 wt % of the utility fluid. The hydroprocessor feed was then hydroprocessed at a temperature of at least 200° C., a pressure of at least 8 MPa, a weight hourly space velocity, based on the gas oil feed and the tar, of at least 0.3 $hr^{-1}$, and a molecular hydrogen consumption rate in a range of from 270 standard cubic meters of molecular hydrogen per cubic meter of the hydroprocessor feed to 534 standard cubic meters of molecular hydrogen per cubic meter of the hydroprocessor feed.

The hydroprocessing stage included a preheater that was operated at a temperature of 250° C., a first hydroprocessing reactor that was operated at a temperature of 250° C. and included a single catalyst bed, a second hydroprocessing reactor that was operated at a temperature of 260° C. and included two serially arranged catalyst beds, and a third hydroprocessing reactor that was operated at a temperature of 367° C. and included four serially arranged catalyst beds. The amount of molecular hydrogen introduced into the first, second, and third hydroprocessing reactors was 15%, 21%, and 64%, respectively, based on the total amount of molecular hydrogen introduced into the hydroprocessing stage. The WHSV through the first hydroprocessing reactor was 6 $hr^{-1}$, through the second hydroprocessing reactor was 2.5 $hr^{-1}$, and through the third hydroprocessing reactor was 0.8 $hr^{-1}$. The total pressure within the hydroprocessing stage was 8.27 MPa-gauge. The hydroprocessing stage was operated for 140 days with no steam cracker gas oil, i.e., only heat-treated tar and utility fluid were introduced or the first 140 days. At 140 days, the feed was switched to the hydroprocessor feed that included the heat-treated gas oil, the heat-treated tar, and the utility fluid. No pressure drop was observed during a run length of 30 days and sulfur conversion was maintained without requiring a temperature increase, which indicates no catalyst deactivation occurred during the month-long run.

Example 3: A laboratory scale hydroprocessing of steam cracker gas oil that was not subjected to heat soaking was also carried out for comparison. The steam cracker gas oil that was not subjected to heat soaking had a bromine number of 42. The hydroprocessor feed included 10 wt % of steam cracker gas oil not subjected to heat soaking, 54 wt % of heat-soaked tar, and 36 wt % of utility fluid. The hydroprocessor feed that contained only 10 wt % of steam cracker gas oil that was not subjected to heat soaking caused fast catalyst deactivation. More particularly, the highly reactive olefins in gas oil not subjected to heat soaking or hydroprocessing, quickly formed coke deposits on the catalyst.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

What is claimed is:

1. A hydrocarbon conversion process, comprising:

(I) providing a gas oil feed comprising a gas oil and an olefin, wherein at least 70 wt % of the gas oil feed, based on the total weight of the gas oil feed, has a normal boing point of at least 200° C. and no more than 10 wt % of the gas oil feed, based on the total weight of the gas oil feed, has a normal boiling point of at least 275° C.;

(II) determining a reactivity R(go) of the gas oil feed;

(III) comparing R(go) to a predetermined reference reactivity R(ref);

(IV) if R(go) >R(ref), heating the gas oil feed to a temperature in a range of from 200° C. to 400° C. for a residence time in a range of from 1 minute to 45 minutes to produce a heat-treated gas oil feed having a reactivity R(ht-go), until R(ht-go)≤R(ref); and (V) feeding a hydroprocessor feed comprising (i) the gas oil feed if R(go)≤R(ref) or (ii) the heat-treated gas oil feed produced in step (IV) to a hydroprocessor; and (VI) hydroprocessing the hydroprocessor feed in the hydroprocessor to produce a hydroprocessor effluent comprising a hydroprocessed gas oil.

2. The process of claim 1, wherein:

R(go) and R(ht-go) are the bromine numbers of the gas oil feed and the heat-treated gas oil feed, respectively;

R(ref) is a bromine number in a range from 23 to 28;

at least 85 wt % of the gas oil feed, based on the total weight of the hydrocarbon feed, has a normal boiling point of at least 200° C. and no more than 5 wt % of the gas oil feed, based on the total weight of the hydrocarbon feed, has a boiling point of at least 275° C.; and the gas oil feed has a viscosity at 50° C. of no greater than $2\times10^{-6}$ $m^2/s$ as determined according to ASTM D445-21.

3. The process of claim 2, wherein R(go)≥30.

4. The process of claim 1, wherein in step (VI), the hydroprocessing is carried out in the presence of a utility fluid comprising two-ring and three-ring aromatic hydrocarbons and having a SBN of at least 100.

5. The process of claim 1, further comprising:

(V') feeding a tar having a reactivity R(tar) into the hydroprocessor, where the at least 70 wt % of the tar, based on the total weight of the tar, has a normal boiling point of at least 290° C., and R(tar)≤R(ref); wherein step (VI) further comprises hydroprocessing the tar in the hydroprocessor, and the hydroprocessor effluent further comprises a hydroprocessed tar.

6. The process of claim 5, wherein the hydroprocessing is carried out in at least one hydroprocessing zone, and wherein the gas oil feed or the heat-treated gas oil feed, the utility fluid, and the tar are combined upstream of the at least one hydroprocessing zone to form the hydroprocessor feed.

7. The process of claim 6, wherein the hydroprocessor feed comprises 10 wt % to 25 wt % of the gas oil feed or the heat-treated gas oil feed, 30 wt % to 50 wt % of the utility fluid, and 35 wt % to 55 wt % of the tar, based on the combined weight of the gas oil feed or the heat-treated gas oil feed, the utility fluid, and the tar.

8. The process claim 1, wherein the gas oil feed further comprises a tar that contains free radicals, wherein at least 70 wt % of the tar, based on the total weight of the tar, has a normal boiling point of at least 290° C., and wherein, if step (IV) is carried out, the heat-treated gas oil feed further comprises heat-treated tar.

9. The process of claim 8, wherein the gas oil feed comprises 15 wt % to 35 wt % of a combined amount of the gas oil and the olefin and 65 wt % to 85 wt % of the tar, based on the combined weight of the gas oil, the olefin, and the tar.

10. The process of claim 8, wherein the hydroprocessing is carried out in the presence of a utility fluid comprising two-ring and three-ring aromatic hydrocarbons and having a SBN of at least 100, wherein the hydroprocessing is carried out in at least one hydroprocessing zone, and wherein the gas oil feed or the heat-treated gas oil feed and the utility fluid are combined upstream of the at least one hydroprocessing zone to form the hydroprocessor feed.

11. The process of claim 10, wherein the hydroprocessor feed comprises 10 wt % to 25 wt % of a combined amount of the gas oil and the olefin in the gas oil feed or the heat-treated gas oil feed, 30 wt % to 50 wt % of the utility fluid, and 35 wt % to 55 wt % of the tar in the gas oil feed or the heat-treated gas oil feed, based on the combined weight of the gas oil feed or the heat-treated gas oil feed and the utility fluid.

12. The process of claim 8, wherein the hydroprocessing is carried out at a temperature of at least 200° C., a pressure of at least 8 MPa, a weight hourly space velocity, based on the gas oil feed and the tar, of at least 0.3 $hr^{-1}$, and a molecular hydrogen consumption rate in a range of from 270 standard cubic meters of molecular hydrogen per cubic meter of the hydroprocessor feed to 534 standard cubic meters of molecular hydrogen per cubic meter of the hydroprocessor feed.

13. The process of claim 1, wherein the gas oil feed comprises steam cracker gas oil.

14. The process of claim 5, wherein the tar comprises steam cracker tar.

15. The process of claim 4, wherein at least a portion of the utility fluid is separated from the hydroprocessor effluent.

16. The process of claim 1, wherein the hydroprocessor feed comprises sulfur, wherein the hydroprocessing of step (VI) is continuously carried out at a temperature of at least 200° C. for a time period of at least 20 days while maintaining sulfur conversion of at least 85%, and wherein the temperature on day 20 is at most 15% greater than the temperature on day 1.

17. The process of claim 1, wherein the hydroprocessor feed comprises sulfur, wherein the hydroprocessing of step (V) is continuously carried out at a pressure of at least 8 MPa for a time period of at least 20 days while maintaining sulfur conversion of at least 85%, and wherein a pressure drop on day 20 is at most 10% greater than a pressure drop on day 1.

18. A hydrocarbon conversion process, comprising:

(A) providing a raw hydroprocessor feed comprising a mixture of steam cracker gas oil and steam cracker tar, wherein:

the raw hydroprocessor feed has a reactivity R(raw) in terms of bromine number, where R(raw) >28, the raw hydroprocessor feed comprises olefins, at least 70 wt % of the steam cracker gas oil has a normal boing point of at least 200° C., at most 10 wt % of the steam cracker gas oil has a normal boiling point of at least 275° C., the steam cracker tar contains free radicals, has a density at 15° C. of at least 1.10 $g/cm^3$, as measured according to ASTM D70/D70M-21, and has a viscosity at 50° C. of at least 1,000 cSt, as measured according to ASTM D445-21, and at least 70 wt % of the steam cracker tar has a normal boiling point of at least 290° C.;

(B) heating the raw hydroprocessor feed to a temperature in a range of from 200° C. to 400° C. for a residence time in a range of from at least 1 minute to 45 minutes to produce a heat-treated raw hydroprocessor feed comprising heat-treated steam cracker gas oil and heat-treated steam cracker tar, wherein the heat-treated raw hydroprocessor feed has a reactivity in terms of bromine number R(ht-raw), where R(ht-raw)≤28;

(C) feeding a hydroprocessor feed comprising the heat-treated raw hydroprocessor feed into a hydroprocessor; and (D) hydroprocessing the hydroprocessor feed in the hydroprocessor to produce a hydroprocessor effluent comprising hydroprocessed steam cracker gas oil and hydroprocessed steam cracker tar.

19. The process of claim 18, wherein the hydroprocessor feed comprises sulfur, wherein the hydroprocessing of step (III) is continuously carried out at a temperature of at least 200° C. for a time period of at least 20 days while maintaining sulfur conversion of at least 85%, and wherein the temperature on day 20 is at most 15% greater than the temperature on day 1.

20. The process of claim 18, wherein the hydroprocessor feed comprises sulfur, wherein the hydroprocessing of step (V) is continuously carried out at a pressure of at least 8 MPa for a time period of at least 20 days while maintaining sulfur conversion of at least 85%, and wherein a pressure drop on day 20 is at most 10% greater than a pressure drop on day 1.

21. The process of claim 18, further comprising mixing the heat-treated raw hydroprocessor feed with a utility fluid to form the hydroprocessor feed, wherein the utility fluid comprises two-ring and three-ring aromatic hydrocarbons and has a SBN of at least 100.

22. The process of claim 21, wherein at least a portion of the utility fluid is separated from the hydroprocessor effluent.

23. The process of claim 18, wherein the hydroprocessing is carried out at a temperature of at least 200° C., a pressure of at least 8 MPa, a weight hourly space velocity, based on the hydroprocessor feed, of at least 0.3 $hr^{-1}$, and a molecular hydrogen consumption rate in a range of from 270 standard cubic meters of molecular hydrogen per cubic meter of the hydroprocessor feed to 534 standard cubic meters of molecular hydrogen per cubic meter of the hydroprocessor feed.

24. The process of claim 18, wherein the raw hydroprocessor feed comprises 15 wt % to 35 wt % of the steam cracker gas oil and 65 wt % to 85 wt % of the steam cracker tar, based on the combined amount of the steam cracker gas oil and the steam cracker tar.

25. The process of claim 21, wherein the hydroprocessor feed comprises 10 wt % to 25 wt % of the heat-treated steam cracker gas oil, 30 wt % to 50 wt % of the utility fluid, and 35 wt % to 55 wt % of the heat-treated steam cracker tar, based on the combined amount of the heat-treated steam cracker gas oil, the utility fluid, and the heat-treated steam cracker tar.

* * * * *